US005817143A

United States Patent [19]

Perry

[11] Patent Number: 5,817,143

[45] Date of Patent: Oct. 6, 1998

[54] APPARATUS AND METHOD FOR SELECTIVE MARKING WITH NATURAL OR ARTIFICIAL LIGHT

[76] Inventor: Kenneth Perry, 21603 Mt. Laurel, Lago Vista, Tex. 78645

[21] Appl. No.: 674,393

[22] Filed: Jul. 2, 1996

[51] Int. Cl.[6] ..... A61N 7/00

[52] U.S. Cl. ..... 607/88; 606/2; 132/319; 132/320; 2/67

[58] Field of Search ..... 607/88, 89, 95; 606/1–2, 116; 2/67, 69; 132/319–320; 428/40

[56] References Cited

U.S. PATENT DOCUMENTS

| | | | |
|---|---|---|---|
| D. 367,730 | 3/1996 | Chiavetta | D28/99 |
| 4,594,276 | 6/1986 | Relyea | 428/40 |
| 5,052,418 | 10/1991 | Miller | 132/319 |
| 5,306,271 | 4/1994 | Zinreich et al. | 606/1 |
| 5,407,440 | 4/1995 | Zinreich et al. | 606/1 |
| 5,470,351 | 11/1995 | Ross et al. . | |
| 5,515,542 | 5/1996 | Simmons . | |

*Primary Examiner*—Robert L. Nasser
*Assistant Examiner*—Ryan Carter
*Attorney, Agent, or Firm*—J. Nevin Shaffer, Jr.; Shaffer & Culbertson

[57] ABSTRACT

An apparatus and method for selective marking using natural or artificial light (10) includes a semi-rigid, flexible design (12) with thread holes (14) in the periphery. A beveled edge (16) is provided around the design edge so that top (18) angles away from bottom (20) along the beveled edge (16). Additionally, a gripping edge (22) is provided so that when the semi-rigid, flexible design (12) is attached to a user's clothing and the semi-rigid, flexible design (12) is brought in contact in the location desired on the user's skin, the semi-rigid, flexible design (12) does not slip or move from its original position. In a preferred embodiment, a universal retainer (24) is provided with interior space (26) and retaining edge (28) for removably receiving a variety of different semi-rigid, flexible designs (12). When exposed to natural or artificial light, a tatoo-like design is created. In another embodiment, a non-threaded, permanent retainer (36) is provided with flexible retaining posts (38). Flexible retaining posts (38) are designed to correspond with thread holes (14) and to pass through the user's clothing and then into thread holes (14) and be retained by the bottom (20) so that the semi-rigid, flexible design (12) is held in place without need of sewing.

6 Claims, 3 Drawing Sheets

APPARATUS AND METHOD FOR SELECTIVE MARKING WITH NATURAL OR ARTIFICIAL LIGHT

BACKGROUND OF THE INVENTION

This invention relates to an apparatus and method for selective marking of a user's body with natural or artificial light.

It is the current fashion for individuals of all ages and walks of life to not only consider but to obtain tatoos. Previously relegated to the more adventurous in society, it is now acceptable and even fashionable for housewives, teenagers, and successful business people to sport tatoos. As with the nature with any fashion, however, what is fashionable today may not be tomorrow and will most certainly not be at some time in the future.

A drawback to body markings in the nature of tatoos, and the like, is that they are essentially irreversible. That is, a tatoo is permanent and stays on a person no matter what the fashion is, except for painful and sometimes not totally successful procedures for removing it.

A small variety of apparatuses and methods are known in the art for providing the look of a tatoo while avoiding the permanency of a real tatoo. For example, the Relyea invention, U.S. Pat. No. 4,594,276, discloses a stick-on image in the nature of a see through tape with a design attached. The tape is supposed to be substantially invisible and the image, therefore, appears to be in the nature of a tatoo. Simmons, U.S. Pat. No. 5,515,542, discloses a garment made of a material that, when wet, displays a second material to provide a tatoo-like effect with the first material appearing to disappear. Other inventors have developed devices that are essentially glued to a person's body in order to facilitate a controlled exposure and controlled prevention of exposure of certain designs on a person's skin. Ross, et al., U.S. Pat. No. 5,570,351, discloses a multi-layer form that is stuck on a person's body. The body part is then exposed to the sun and when the sticky film is removed, it leaves an untanned area of skin in the shape of the precise design that has been attached. In a variation of this, Miller, U.S. Pat. No. 5,052,418, discloses a template designed to be removably glued to a person's body. Once applied, an outline or design area is filled in with sun block and then the device is removed. Once exposed to the sun, the area with the sun block is free from tan, and produces, therefore, a design in the shape of the device or the template. A design patent to Chiavetta, U.S. Pat. Design No. 367,730, discloses a sheet of "sun tatoos" in a variety of designs.

A drawback to these non-permanent marking systems, is that they are required to be glued in some manner to a person's body and, therefore, are susceptible to imperfect application due to body shapes and sizes, skin conditions, hair and the like, and may cause irritation by their application alone from the adhesive that is used. Additionally, there is no ability to utilize these devices in conjunction with sportswear such as swim suits, jogging suits, exercise outfits and the like, since their utilization requires an exposed area of skin to which they may be attached.

Thus, there is a need in the art for providing an apparatus and method for selective marking of a user's body which is not permanent and, yet, which yields a satisfactory imitation of a tatoo that may be attached to a user's clothing, that is repeatable, safe, hygienic, does not risk the transference of disease, and which may be changed or abandoned altogether according to the user's whim. It, therefore, is an object of this invention to provide an apparatus and method for selective marking of a user's body with natural and artificial light such that a marking, in the nature of a tatoo, may be temporarily achieved.

SHORT STATEMENT OF THE INVENTION

Accordingly, the apparatus for selective marking with natural or artificial light includes a semi-rigid, flexible design conformed to be removably attached to a user's clothing. The semi-rigid, flexible design includes a beveled edge that allows the light direct access, without shading, to the base of the design. Additionally, the semi-rigid, flexible design includes thread holes around the outer periphery of the design so that the design may be sewn into material such as a bathing suit, tank top and the like, for use by the wearer. In another embodiment, the invention includes a gripping edge on the bottom of the design for resisting movement of the semi-rigid, flexible design once the design is placed in position on the user's body. Still further, another embodiment includes the incorporation of a universal retaining means for removably attaching various semi-rigid, flexible designs, without thread holes, so that a user can easily change the desired design from time to time.

Still further, another embodiment includes a non-threaded retaining ring utilized in conjunction with the threaded flexible design that attaches to a user's clothing without need of sewing and which permanently connects to the threaded design.

The method for selective marking with natural or artificial light includes the steps of providing a semi-rigid, flexible design and creating an attachment for attaching it to a user's clothing. The design is then attached to the user's clothing, clothing removed from behind design, and exposed to natural or artificial light so that the skin of the user is tanned in the shape of the design.

BRIEF DESCRIPTION OF THE DRAWINGS

Other objects, features and advantages of the present invention will become more fully apparent from the following detailed description of the preferred embodiment, the appended claims and the accompanying drawings in which:

DETAILED DESCRIPTION OF THE PREFERRED EMBODIMENT

Figure 1:
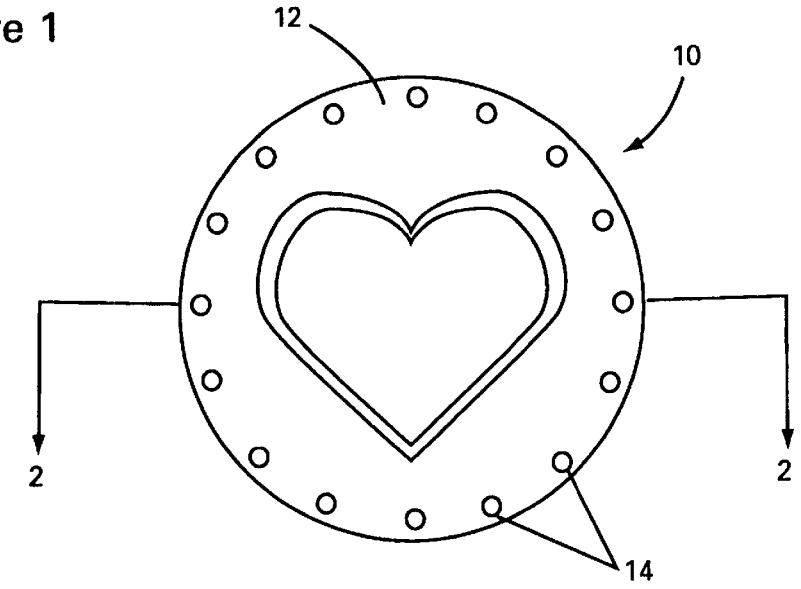
FIG. 1 is a top view of a preferred embodiment of the present invention.
Figure 2:
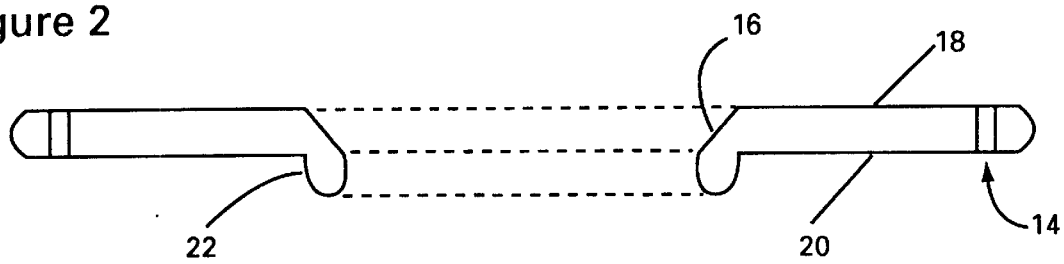
FIG. 2 is a side section view taken along lines 2—2 of FIG. 1.

The preferred embodiment of the present invention is illustrated by way of example in FIGS. 1–2. With specific reference to FIGS. 1 and 2, an apparatus for selective marking 10 includes a semi-rigid, flexible design 12 shown in a heart shape, but which may be made in any convenient or desirable design. Semi-rigid, flexible design 12 has thread holes 14 around the periphery of the design so that semi-rigid, flexible design 12 may be attached to a user's clothing.

As more clearly shown in FIG. 2, semi-rigid, flexible design 12 includes a beveled edge 16. Semi-rigid, flexible design 12 has a top 18 and a bottom 20 and, as can be seen from the drawings, beveled edge 16 angles away from the vertical from bottom 20 to top 18 of the design 12. FIG. 2 also illustrates a gripping edge 22 along the bottom of the design 12.

Figure 3:
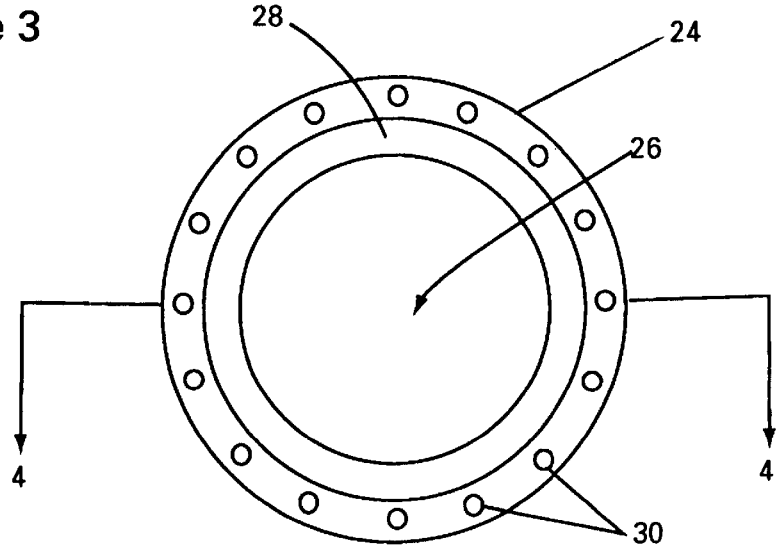
FIG. 3 is a top view of a universal retainer to be utilized in conjunction with the modified invention of FIGS. 1 and 2 as shown in FIG. 5.
Figure 4:
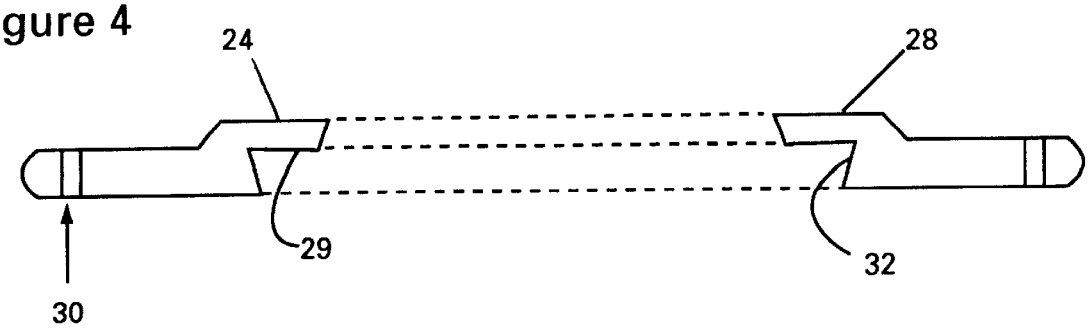
FIG. 4 is a side section view taken along Lines 4—4 of FIG. 3.
Figure 5:
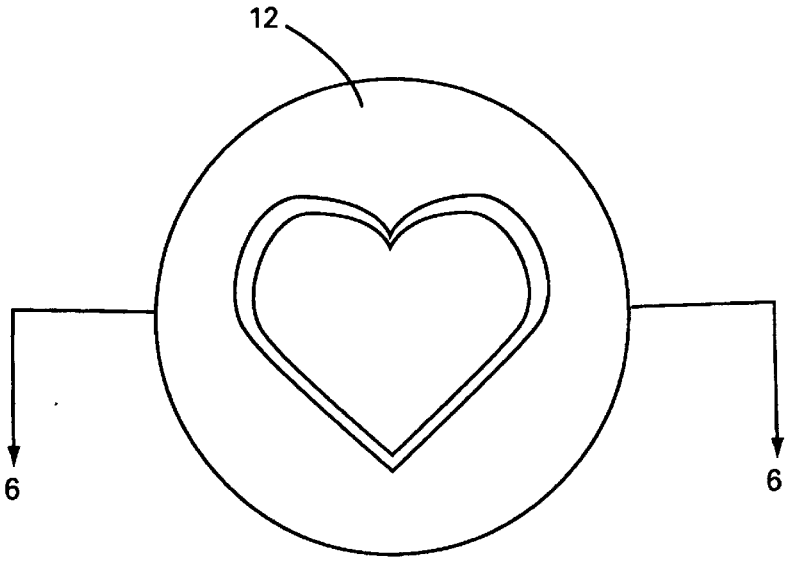
FIG. 5 is a top view of a modified invention without thread holes to be utilized in conjunction with the universal retainer of FIG. 3.
Figure 6:
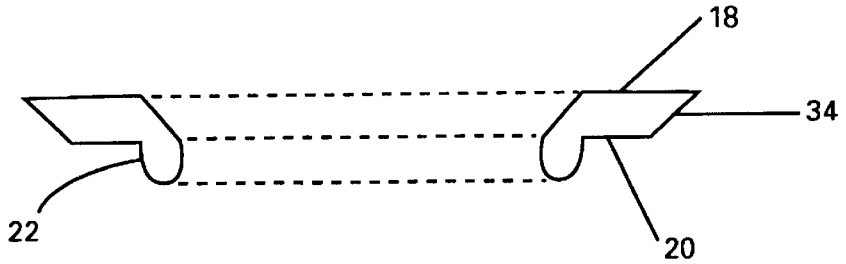
FIG. 6 is a side section view taken along Lines 6—6 of FIG. 5.

Referring now to FIG. 3, a universal retainer 24 is illustrated. Universal retainer 24 has an interior space 26 and retaining edge 28 designed and conformed to just receive semi-rigid, flexible design 12 and retain it in position temporarily. Universal retainer 24 also includes thread holes 30 so that, in this alternative embodiment of the invention, universal retainer 24 is sewn into the user's clothing and a semi-rigid, flexible design of the user's choice, but, preferably, without thread holes 14, as shown in FIGS. 5 and 6, is snapped into place in universal retainer 24 for use by the user. After use, and should the design be desired to be changed, the user simply snaps semi-rigid, flexible design 12 from universal retainer 24 and replaces it with a new semi-rigid, flexible design 12. Again, the semi-rigid, flexible design 12 that is utilized in conjunction with universal retainer 24 is identical to the semi-rigid, flexible design 12 illustrated in FIG. 1, except that the periphery, preferably, does not include thread holes 14. Referring to FIG. 4, the side section view of the universal retainer 24 illustrates the retaining means of the invention formed by the combination of retaining edge 28 and angled retaining side 32.

Referring to FIG. 6, the semi-rigid, flexible design 12 in this embodiment has no thread holes, but instead, has corresponding angled sides 34 which correspond to angled sides 32 so that when semi-rigid, flexible design 12 is snapped into place on retainer 24, it is held in place until forcibly removed. That is, when the semi-rigid, flexible design 12 of FIG. 5 is snapped into retainer 24, the top 18 comes into direct contact with the bottom 29 of retaining edge 28.

Figure 7:
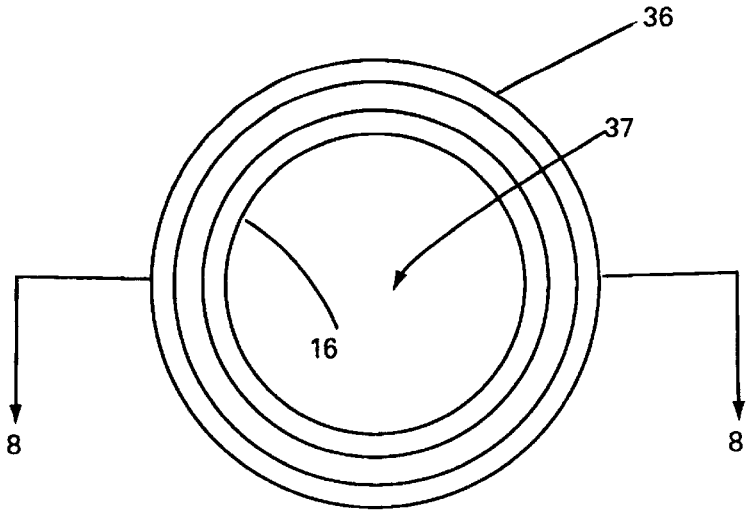
FIG. 7 is a top view of a non-thread hole universal retainer to be utilized in conjunction with the invention of FIGS. 1 and 2.
Figure 8:
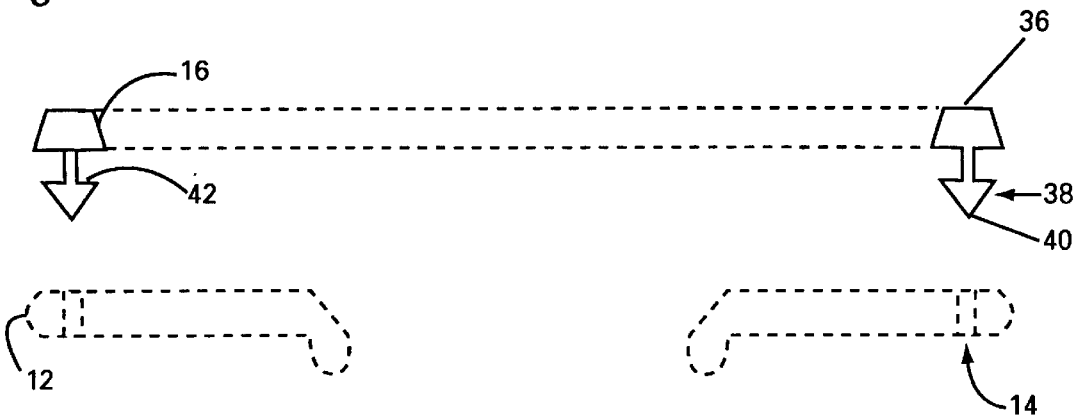
FIG. 8 is a side section view of the non-thread hole retainer of FIG. 7.

Referring now to FIG. 7, non-threaded, permanent retainer 36 is disclosed. As shown in FIGS. 7 and 8, non-threaded, permanent retainer 36 has a beveled edge 16 and flexible retaining posts 38. Non-threaded, permanent retainer 36 is designed to be utilized in conjunction with semi-rigid, flexible design 12 illustrated in FIGS. 1 and 2. That is, with semi-rigid, flexible design 12 with thread holes 14. In this embodiment, semi-rigid, flexible design 12 is placed on top of the outside surface of the chosen clothing, i.e. a swim suit. The swim suit is then folded up around semi-rigid, flexible design 12 and passed through the center open space 37 of non-threaded permanent retainer 36. Non-threaded, permanent retainer 36 is then pressed into permanent relationship with semi-rigid, flexible design 12 by pressing flexible retaining posts 38 through the material and into thread holes 14 so that the flexible retaining posts 38 pass through the thread holes 14 and are retained in position by the combination of flexible retaining posts 38 and bottom 20. That is, flexible retaining posts 38 are formed in a conical design with a point 40 and a broad base 42. The point 40 enables flexible retaining posts 38 to easily pass through the material of the user's swim suit, for example, and to be directed into thread holes 14. When pressed together, flexible retaining posts broad base 42 compresses slightly while passing through thread holes 14 and then expands against the bottom 20 of semi-rigid, flexible design 12 and thereby securely fastens the material between non-threaded, permanent retainer 36 and semi-rigid, flexible design 12. Once in place, material covering the design, in the shape of a heart, in this illustration, would be cut away without fear that the material would pull away since it is held in place by the plurality of flexible retaining posts 38 that correspond exactly to the number of thread holes 14 in semi-rigid, flexible design 12.

In the preferred embodiment of the invention, the apparatus for selective marking using natural or artificial light 10, includes a semi-rigid, flexible design 12 that is approximately 1⅓ inches in diameter and 1/16th inch thick. Semi-rigid, flexible design 12 can be made of any appropriate material such as plastic, rubber, silicone or the like. Additionally, in a preferred embodiment, the beveled edge 16 is angled at 45 degrees off vertical. The inventor has found that this angle allows light more direct access to the bottom edge of the design, that is the part of the design in contact with the user's skin, without casting shadows. Additionally, gripping edge 22 has been found to be most satisfactory when it is approximately 1/16 inch long.

In use, then, the apparatus for selective marking 10 requires the creation of a semi-rigid, flexible design 12. The heart shaped design illustrated in FIG. 1 is for purposes of illustration only and is not meant to limit the scope of the invention to this particular design at all. Certainly, any imaginable design such as arrows, diamonds, cloverleaves, half-moons, moons, stars, lightning bolts, exclamation points, numbers, musical symbols, animal shapes, logos, or the like may be incorporated, limited only by the individual's imagination. In any event, once the desired design has been selected, and the semi-rigid, flexible design 12 created, thread holes 14 are provided in the periphery of the semi-rigid, flexible design 12 and the semi-rigid, flexible design 12 is attached to some particular location of the user's clothing. Certainly, while thread holes 14 are the preferred embodiment, any similar or satisfactory means for attaching semi-rigid, flexible design 12 to a user's clothing is appropriate, i.e., gluing, buckling, snapping, hook and loop material, and so forth.

The inventor has found that the semi-rigid, flexible design 12 can be incorporated in bathing suits, tank tops, jogging shorts, and shirts, socks, gloves, and virtually any clothing, including underwear. That is, it may be that the design is for "private viewing" only and, certainly, any known clothing which could hold the semi-rigid, flexible design 12 is appropriate.

Once attached to the desired clothing, the clothing is cut away from the design and the beveled edge 16, in combination in one embodiment with gripping edge 22, ensures that the semi-rigid, flexible design 12 exposes the skin in the design to the maximum amount of light without casting undue shadows so that a sharp design is created as the skin is tanned and that the semi-rigid, flexible design 12 does not move on the user's body during the tanning process.

For users that desire to change, modify or realign the image to be obtained, universal retainer 24 can be utilized. The universal retainer 24 is designed with thread holes 30 for attachment, as discussed above, to any desired piece of the user's clothing. Once in place, retaining edge 28 in cooperation with interior space 26 is designed to releasably attach a semi-rigid, flexible design 12. While semi-rigid, flexible design 12 may have thread holes 14, in a preferred embodiment, these thread holes 14 would be absent when using semi-rigid, flexible design 12 in combination with universal retainer 24.

For users that do not desire to sew the semi-rigid, flexible design 12 into their clothing, non-threaded, permanent retainer 36 may be used. In this embodiment, a semi-rigid, flexible design 12 of the user's choice which includes thread holes 14 is selected. As discussed above, semi-rigid, flexible design 12 is held in permanent relationship with non-threaded, permanent retainer 36 by means of flexible retaining posts 38. Once in position on the user's chosen clothing, the clothing beneath the design is cut away, without fear that the clothing will retract beyond flexible retaining posts 38, and the desired design is exposed to the user's skin.

By means of the present invention, then, a manner and means for leaving a safe, painless, non-permanent tatoo-like mark on one's body is provided by a safe means, i.e., utilization of natural or artificial light to create a sun tan in a particular selected design. The apparatus for selective marking 10, therefore, has a wide entertainment value and the advantage that it is not capable of causing infection or disease since it is in itself sterile, painless and requires no needles, bloodshed or associated pain and discomfort. Thus, the apparatus and method for selective marking using natural or artificial light of the present invention has the important advantage of providing a safe hygienic means of creating a tatoo-like design.

While the present invention has been disclosed in connection with the preferred embodiment thereof, it should be understood that there may be other embodiments which fall within the spirit and scope of the invention as defined by the following claims.

I claim:

1. A method for selective marking with natural or artificial light comprising the steps of:

(a) providing a semi-rigid, flexible design means, with a top and a bottom, for allowing light to reach a user's body;

(b) creating attachment means for attaching the semi-rigid, flexible design means to clothing;

(c) providing a beveled edge in the design of the semi-rigid, flexible design means;

(d) attaching the semi-rigid, flexible design means to clothing;

(e) removing a portion of clothing from beneath the design;

(f) wearing the clothing with the semi-rigid, flexible design means attached to clothing; and (g) exposing the semi-rigid, flexible design means to natural or artificial light so that the skin of the user is tanned in the shape of semi-rigid, flexible design means.

2. The method of claim 1 wherein providing attachment means further comprises the step of providing thread holes around the outer periphery of the semi-rigid, flexible design means.

3. The method of claim 1 wherein providing a beveled edge further comprises the step of angling the beveled edge at approximately 45 degrees from vertical.

4. The method of claim 1 further comprising the step of providing a gripping edge on the bottom for resisting movement of the semi-rigid, flexible design means once placed in position on the user's body.

5. The method of claim 1 further comprising the step of providing a universal retaining means for removably attaching various semi-rigid, flexible design means so that a user can easily change the desired semi-rigid, flexible design means.

6. The method of claim 2 further comprising the step of:

(a) providing a non-threaded, permanent retainer with flexible retaining posts; and (b) pressing the flexible retaining posts through the thread holes so that the flexible design means is held in place without need of sewing.

* * * * *